US009122233B2

(12) United States Patent
Kawahara

(10) Patent No.: US 9,122,233 B2
(45) Date of Patent: Sep. 1, 2015

(54) IMAGE FORMING DEVICE INCLUDING MECHANISM FOR MOVING DEVELOPER CARTRIDGE

(71) Applicant: Eiji Kawahara, Nagoya (JP)

(72) Inventor: Eiji Kawahara, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/225,747

(22) Filed: Mar. 26, 2014

(65) Prior Publication Data

US 2014/0294439 A1 Oct. 2, 2014

(30) Foreign Application Priority Data

Mar. 28, 2013 (JP) ..... 2013-069296

(51) Int. Cl.
*G03G 21/16* (2006.01)

(52) U.S. Cl.
CPC ..... *G03G 21/1676* (2013.01); *G03G 21/1623* (2013.01); *G03G 2221/1684* (2013.01)

(58) Field of Classification Search
CPC ..... G03G 21/1623; G03G 2221/1684; G03G 21/1676
USPC ..... 399/110, 111, 119
See application file for complete search history.

(56) References Cited

U.S. PATENT DOCUMENTS

| | | | | |
|---|---|---|---|---|
| 8,204,405 | B2 * | 6/2012 | Mushika et al. | 399/119 |
| 8,311,451 | B2 | 11/2012 | Nishimura et al. | |
| 2009/0123191 | A1 * | 5/2009 | Okuda | 399/260 |
| 2010/0021203 | A1 | 1/2010 | Nishimura et al. | |
| 2012/0237256 | A1 | 9/2012 | Souda | |
| 2013/0022369 | A1 | 1/2013 | Nishimura et al. | |

FOREIGN PATENT DOCUMENTS

| | | | |
|---|---|---|---|
| JP | 2010-026299 | A | 2/2010 |
| JP | 2012-194395 | A | 10/2012 |

* cited by examiner

*Primary Examiner* — Sandra Brase
(74) *Attorney, Agent, or Firm* — Banner & Witcoff, Ltd.

(57) ABSTRACT

An image forming device includes a main body, developer cartridges, a drawer, and an ejecting mechanism. The drawer is movable relative to the main body. The developer cartridges are juxtaposed in a predetermined direction and detachably attached to the drawer. Each developer cartridge includes a developing roller whose rotational axis extends in an axial direction orthogonal to the predetermined direction. The ejecting mechanism moves at least one developer cartridge from an attached position in a moving direction relative to the drawer. The moving direction intersects the predetermined direction and is orthogonal to the axial direction. The ejecting mechanism includes an operating part and an actuating part. The actuating part moves the at least one developer cartridge from the attached position in the moving direction in response to the operating part receiving an operating force.

20 Claims, 6 Drawing Sheets

IMAGE FORMING DEVICE INCLUDING MECHANISM FOR MOVING DEVELOPER CARTRIDGE

CROSS REFERENCE TO RELATED APPLICATION

This application claims priority from Japanese Patent Application No. 2013-069296 filed Mar. 28, 2013. The entire content of the priority application is incorporated herein by reference.

TECHNICAL FIELD

The present invention relates to an image forming device.

BACKGROUND

For example, Japanese unexamined patent application publication No. 2010-26299 describes an image-forming device having a drawer that can be pulled out from the body of the device, and a plurality of developer cartridges that are detachably mounted in the drawer. Each developer cartridge is provided with a grip part by which a user can hold the developer cartridge. The grip part can be displaced between a stored position in which the grip part is retracted into the drawer, and a grippable position in which the grip part sticks out enough for the user to grasp.

SUMMARY

However, in the conventional image-forming device described above, the moving mechanism that enables the grip part to be moved between its stored position and grippable position is provided in the developer cartridge itself. This arrangement is not conducive to a compact drawer unit having developer cartridges, a drawer, and the like.

In view of the foregoing, it is an object of the present invention to provide an image-forming device that is conducive to a compact drawer unit.

In order to attain the above and other objects, the invention provides an image forming device including a main body, a plurality of developer cartridges, a drawer, and an ejecting mechanism. The plurality of developer cartridges are juxtaposed in a predetermined direction. Each of the plurality of developer cartridges includes a developing roller whose rotational axis extends in an axial direction orthogonal to the predetermined direction. The drawer is configured to move relative to the main body. The plurality of developer cartridges are detachably attached to the drawer. The developer cartridges are disposed at a first position when the developer cartridges are attached to the drawer, respectively. The ejecting mechanism is configured to move at least one of the plurality of developer cartridges from the first position in a moving direction relative to the drawer. The moving direction intersects the predetermined direction and is orthogonal to the axial direction. The ejecting mechanism includes an operating part and an actuating part. The operating part is configured to receive an operating force. The actuating part is configured to move the at least one of the plurality of developer cartridges from the first position in the moving direction in response to the operating part receiving the operating force.

BRIEF DESCRIPTION OF THE DRAWINGS

The particular features and advantages of the invention as well as other objects will become apparent from the following description taken in connection with the accompanying drawings, in which.

DETAILED DESCRIPTION

Figure 1:
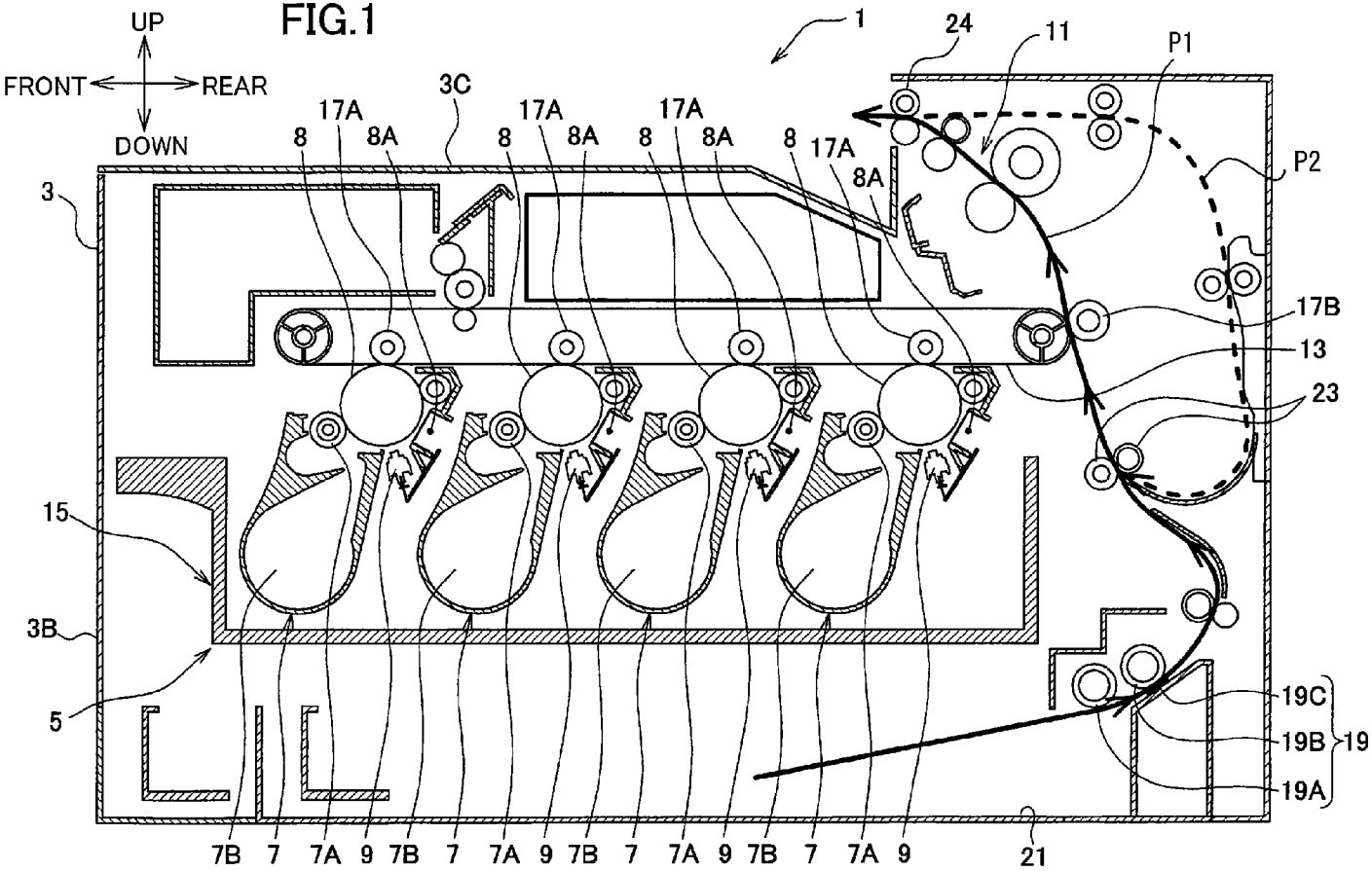
FIG. 1 is an center cross-sectional view of an image forming device according to an embodiment of the present invention.

Next, the invention will be described in detail with reference to specific embodiment thereof. It would be apparent to those skilled in the art that many modifications and variations may be made therein without departing from the spirit of the invention, the scope of which is defined by the attached claims.

Next, an embodiment of the present invention will be described while referring to FIGS. 1-6B. In the embodiment described below, the invention is applied to an intermediate transfer type image-forming device. Arrows indicating directions and the like in the drawings are intended to facilitate understanding of how the drawings relate to each other, and the present invention is not limited to these specified directions. The present invention is provided with at least one of those parts and components designated with symbols or reference numerals, except when the parts and components are specifically specified as being a "plurality," "two or more," or the like.

FIG. 1 shows an image-forming device 1 according to a first embodiment. The image-forming device 1 includes a casing 3, and an electrophotographic image-forming unit 5 housed in the casing 3 for forming images on sheets of a recording medium.

The image-forming unit 5 includes four developer cartridges 7, four photosensitive drums 8, four exposure units 9, and a fixing unit 11.

Each of the developer cartridges 7 has a developing roller 7A, and a storage section 7B. The storage sections 7B are configured to store developer. The developing rollers 7A are arranged such that their rotational axes are parallel to one another. The developer cartridges 7 are juxtaposed in a direction D2 orthogonal to the rotational axes of the developing rollers 7A. The direction in which the developer cartridges 7 are juxtaposed will hereinafter be called the "juxtaposed direction." The juxtaposed direction D2 in the embodiment is aligned with the front-rear direction of the image-forming device 1. The developer cartridges 7 are arranged such that the colors of developer stored in their respective storage sections 7B are in the order yellow, magenta, cyan, and black beginning from the front side of the image-forming device 1 equivalent to one side in the juxtaposed direction D2 and continuing toward the rear side of the image-forming device 1 equivalent to the other side in the juxtaposed direction D2.

The same numbers of photosensitive drums 8 and exposure units 9 are provided to correspond to the developer cartridges 7. The photosensitive drums 8 are arranged such that their rotational axes are parallel to one another and to the rotational axes of the developing rollers 7A. The photosensitive drums 8 are configured to carry toner images on their surfaces.

Four chargers 8A are disposed adjacent to corresponding photosensitive drums 8 for charging the surfaces of the same.

The exposure units 9 are configured to irradiate light onto the charged surfaces of the corresponding photosensitive drums 8 to form electrostatic latent images thereon. Each of the developing rollers 7A is configured to supply developer stored in the corresponding storage section 7B to the corresponding photosensitive drum 8 to develop the corresponding latent image into a developer image.

Figure 2:
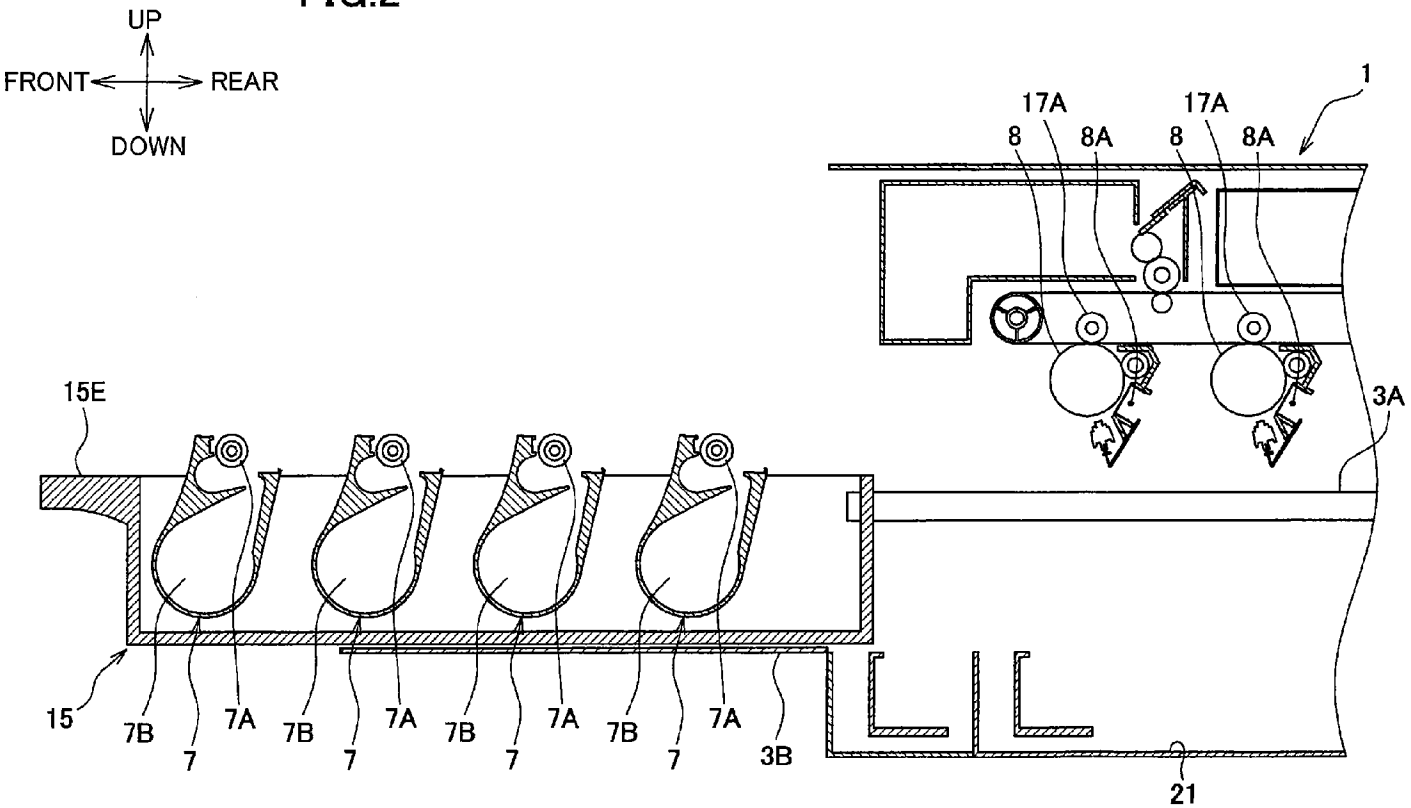
FIG. 2 is an explanatory diagram showing a drawer unit pulled out of a main body of the image forming device according to the embodiment.

The developer cartridges 7 are detachably attached to a drawer 15. As illustrated in FIG. 2, the drawer 15 is configured to move relative to a main body. Here, the "main body" denotes any part of the image-forming device 1 that the user cannot detach or replace, such as the casing 3 and a main frame (not shown). The drawer 15 moves in a horizontal direction parallel to the juxtaposed direction D2.

A door 3B is provided on the front of the casing 3 and can be opened and closed thereon. By opening the door 3B, the user can pull the drawer 15 forward through the door 3B and out of the main body. Once the drawer 15 has been pulled out of the main body, the developer cartridges 7 are exposed on the outside of the casing 3 with the developing rollers 7A positioned on top. In this state, the operator can remove the developer cartridges 7 from the drawer 15 and attach the developer cartridges 7 into the drawer 15. In other words, the user can pull the drawer 15 out of the main body in order to move all four developer cartridges 7 out of the main body as a unit, and can subsequently remove the developer cartridges 7 from and attach the developer cartridges 7 in the drawer 15.

Note that the photosensitive drums 8 and exposure units 9 in the embodiment are not integrally configured with the respective developer cartridges 7. Hence, the photosensitive drums 8 and exposure units 9 remain inside the casing 3 when the drawer 15 is pulled out of the main body.

As shown in FIG. 1, the image-forming unit 5 includes a transfer belt 13 that circulates in contact with the photosensitive drums 8. The surface of the transfer belt 13 that contacts the photosensitive drums 8 (hereinafter referred to as the "transfer surface") moves from one side to the other side in the juxtaposed direction D2 (from front to rear in the embodiment).

Four first transfer bodies 17A are disposed on the inner side of the transfer belt 13 at positions confronting the corresponding photosensitive drums 8. The first transfer bodies 17A are configured to transfer developer images carried on the surfaces of the respective photosensitive drums 8 to the transfer belt 13. The developer images are superimposed on each other when transferred to the transfer belt 13.

A second transfer body 17B is disposed downstream of the first transfer bodies 17A in the direction that the transfer surface moves (in a direction parallel to the front-to-rear direction). The second transfer body 17B transfers the superimposed developer images from the transfer belt 13 onto a sheet. The fixing unit 11 applies heat and pressure to the developer transferred onto the sheet to fix the developer images to the sheet. A pair of discharge rollers 24 is configured to discharge sheets on which images have just been formed onto a discharge tray 3C provided on the top of the casing 3. A conveying path P1 for guiding the sheet is depicted with an arrow line in FIG. 1.

The image-forming device 1 is also provided with a paper tray 21, a feeding mechanism 19, and a pair of registration rollers 23.

The paper tray 21 is provided in the bottom section of the casing 3 and is configured to accommodate stacked sheets of a recording medium. The paper tray 21 is removably mounted in the main body and is capable of moving in and out of the main body in the front-rear direction.

The feeding mechanism 19 is disposed above the rear end of the paper tray 21. The feeding mechanism 19 is configured to convey sheets from the paper tray 21 one at a time toward the image-forming unit 5. The feeding mechanism 19 includes a pickup roller 19A, a separating roller 19B, and a separating pad 19C.

The pickup roller 19A rotates in contact with the topmost sheet stacked in the paper tray 21, thereby applying a force to the sheet for conveying the same. The separating roller 19B works in conjunction with the separating pad 19C to separate multiple overlapped sheets fed by the pickup roller 19A.

The registration rollers 23 are disposed downstream of the feeding mechanism 19 and upstream of the second transfer body 17B in a sheet-conveying direction. The registration rollers 23 temporarily halt conveyance of a sheet supplied from the feeding mechanism 19, correcting the orientation of the sheet so that the leading edge is orthogonal to the sheet-conveying direction before conveying the sheet toward the second transfer body 17B. After correcting skew in the sheet in this way, the registration rollers 23 convey the sheet so that the sheet enters between the second transfer body 17B and transfer belt 13 at a preset timing. The developer images superimposed on the transfer belt 13 are subsequently transferred onto the sheet conveyed between the second transfer body 17B and transfer belt 13, forming an image on the sheet.

The image-forming device 1 is capable of forming images on both front and back surfaces of the sheet. To form an image on the back surface of a sheet after an image has first been formed on the front surface, the conveying direction or rotation direction of the discharge rollers 24 is reversed after the trailing edge of the sheet arrives at the discharge rollers 24 so that the sheet is conveyed along the conveying path P2 depicted with a dashed line for guiding the sheet back to the input side of the registration rollers 23. In this way, the registration rollers 23 can once again convey the sheet between the second transfer body 17B and transfer belt 13 to form an image on the back surface.

Figure 3:
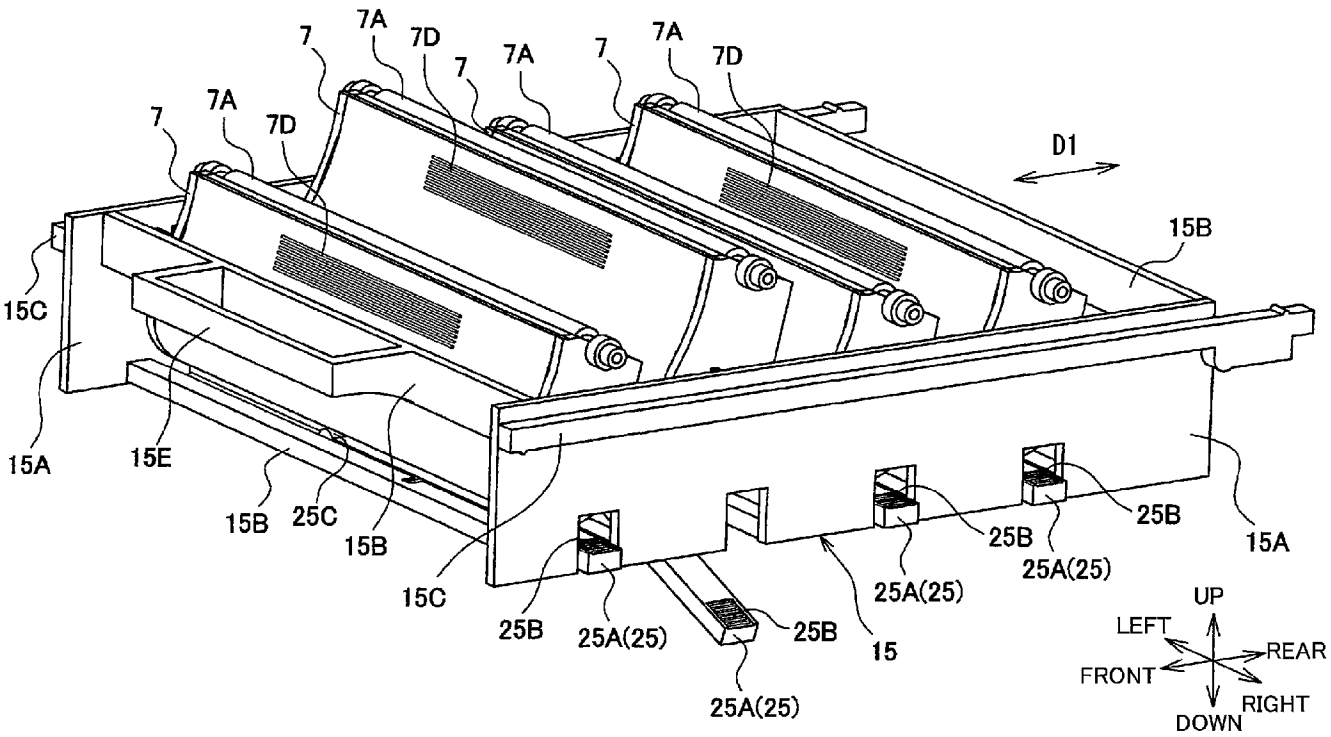
FIG. 3 is a perspective view of the drawer unit including a drawer and a developer cartridge attached to the drawer.

As shown in FIG. 3, the drawer 15 has a box-shaped body that is open on the top. The drawer 15 is configured to be pulled out of the casing 3 and to accommodate the four developer cartridges 7. More specifically, the drawer 15 has a pair of side walls 15A, bridging members 15B, guide rails 15C, second guide parts 15D (FIGS. 5A-5C), and a handle 15E.

The side walls 15A are positioned on opposite sides of the developer cartridges 7 in the left-right direction. The side walls 15A are plate-shaped members that are elongated in the juxtaposed direction D2, i.e., a drawer-moving direction D1 in which the drawer 15 moves.

The bridging members 15B extend in the left-right direction for bridging the side walls 15A.

One of the guide rails 15C is provided on the outer surface of each side wall 15A. The guide rails 15C are oriented to extend in the juxtaposed direction D2. The guide rails 15C move relative to first guide parts 3A described later (see FIG. 2) while in contact with the same.

A plurality of the second guide parts 15D is provided on each side wall 15A. The second guide parts 15D are provided on the left-right inner surface of each side walls 15A for guiding movement of the developer cartridges 7 when the developer cartridges 7 are mounted in and removed from the drawer 15.

The handle 15E is provided on one side of the drawer 15 in the drawer-moving direction D1 that the drawer 15 moves (the front side in the embodiment). The user grips the handle 15E when moving the drawer 15 in and out of the main body.

The first guide parts 3A are guide rails provided in the main body and oriented to extend in a direction parallel to the juxtaposed direction D2, i.e., the front-rear direction. Hence, the first guide parts 3A guide the drawer 15 in the juxtaposed direction D2 as the drawer 15 moves in and out of the main body. The first guide parts 3A are configured as grooved parts in which the corresponding guide rails 15C are slidably fitted. Thus, the first guide parts 3A are configured to hold the drawer 15 in the main body so as to be capable of moving in and out of the same along the first guide parts 3A.

Contact/separation guide parts (not shown) are also provided in the main body for moving the drawer 15 in a direction orthogonal to the transfer surface. The "direction orthogonal to the transfer surface" is a direction that intersects the direction in which the guide rails 15C extend and in which the drawer 15 is moved to separate from or approach the photosensitive drums 8. That is, the contact/separation guide parts are configured to move the drawer 15 vertically in the embodiment.

Therefore, when pulling the drawer 15 out of the main body, the user first opens the door 3B. In association with this opening operation, the drawer 15 is displaced downward along the contact/separation guide parts so as to separate from the photosensitive drums 8. Subsequently, the user can grip the handle 15E and pull the drawer 15 outward as the drawer 15 is guided horizontally along the first guide parts 3A. Accordingly, the drawer 15 can be pulled out of the casing 3 without interfering with the photosensitive drums 8 and exposure units 9.

When mounting the drawer 15 in the main body, the user first pushes the drawer 15 into the casing 3 so that the drawer 15 moves horizontally while guided by the first guide parts 3A. Subsequently, the user closes the door 3B and, in association with this closing operation, the drawer 15 is displaced upward along the contact/separation guide parts so as to approach the photosensitive drums 8.

When the drawer 15 is completely mounted in the main body, i.e., in a state capable of performing image-forming operations, the developing rollers 7A are in contact with the corresponding photosensitive drums 8.

As shown in FIG. 3, the drawer 15 has an ejecting mechanism 25 for moving the developer cartridges 7 attached to in the drawer 15 away from the drawer 15 (hereinafter referred to as the "ejecting direction" or the "cartridge-moving direction"). The ejecting direction intersects the juxtaposed direction D2 of the developer cartridges 7 and is orthogonal to the rotational axes of the developing rollers 7A. Hence, the ejecting direction is the upward direction in the embodiment.

The ejecting mechanism 25 has a plurality of ejecting levers 25A juxtaposed at positions corresponding to the developer cartridges 7 and extending in a direction parallel to the axial direction of the developer cartridges 7. The ejecting levers 25A are arranged at intervals equivalent to the intervals of the developer cartridges 7.

Figure 4A:
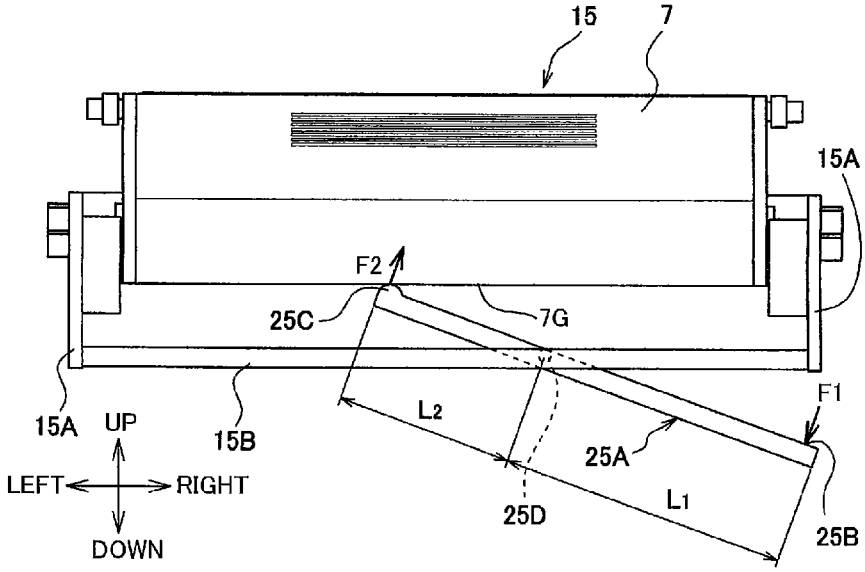
FIG. 4A is an explanatory diagram showing the drawer unit when an ejecting mechanism is operated.

As shown in FIG. 4A, each ejecting lever 25A has an operating part 25B, and an actuating part 25C. By operating the ejecting levers 25A, it is possible to move the corresponding developer cartridges 7 independently.

The operating part 25B is the portion of the ejecting lever 25A configured to receive an operating force. The actuating part 25C is the portion of the ejecting lever 25A that uses the operating force applied to the operating part 25B to exert an actuating force on the developer cartridge 7 in order to move the developer cartridge 7 in the ejecting direction. In other words, the actuating part 25C is configured to move the corresponding developer cartridge 7 from an attached position (FIG. 4B) to an ejection position (FIG. 4A) upward in response to the operating part 25B receiving the operating force. The ejecting levers 25A are pivotably mounted in the bottom portion of the drawer 15, such as on the bridging members 15B. That is, the ejecting mechanism 25 has a plurality of pivoting shafts 25D corresponding to the plurality of developer cartridges 7 (the plurality of ejecting levers 25A). Each of the plurality of ejecting levers 25A is configured to pivot about corresponding one of the plurality of pivoting shafts 25D. Each pivoting shaft 25D has an axis that is parallel to the juxtaposed direction. The operating parts 25B of the ejecting levers 25A are provided on one side of the shaft 25D, while the actuating parts 25C are provided on the other side of the pivoting shaft 25D.

Each operating part 25B is positioned on only one longitudinal side of the developer cartridge 7. That is, the operating parts 25B are provided in only one side wall 15A and not in the side wall 15A on the other side of the developer cartridge 7. Here, the longitudinal direction of the developer cartridge 7 is the direction extending from the side wall 15A on one side of the developer cartridge 7 to the side wall 15A on the other side and is parallel to the rotational center of the developing roller 7A.

Figure 4B:
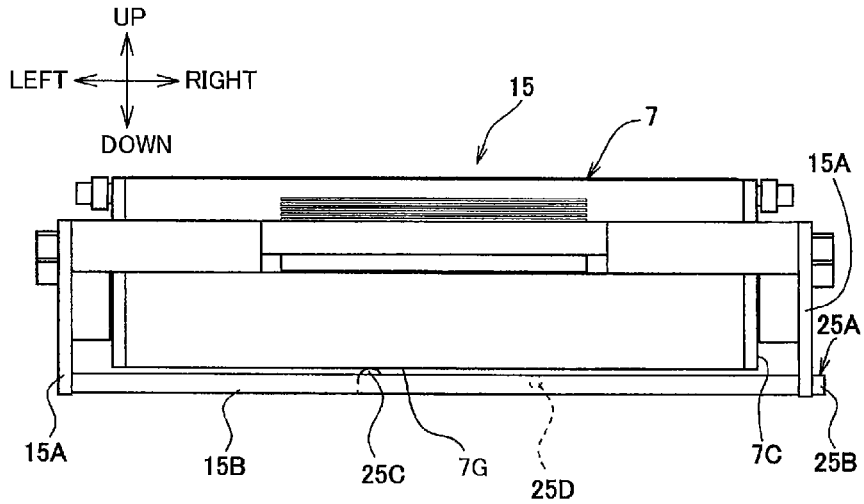
FIG. 4B is an explanatory diagram showing the drawer unit when the ejecting mechanism is not operated.

When the developer cartridge 7 is attached to the drawer 15 as shown in FIG. 4B, the operating part 25B is positioned on the opposite side of a longitudinal end 7C of the developer cartridge 7 from the longitudinal center region of the developer cartridge 7. The actuating part 25C on the other hand is positioned in the approximate longitudinal center region of the developer cartridge 7. The actuating part 25C exerts an actuating force on the developer cartridge 7 at an intermediate position between the side walls 15A.

In the embodiment, the user operates the operating part 25B directly by pressing the operating part 25B downward. As shown in FIG. 3, ridges are formed on the operating part 25B to prevent the user's finger from slipping off the end of the operating part 25B. As shown in FIG. 4A, the actuating part 25C directly contacts a bottom surface 7G of the corresponding developer cartridge 7 when the operating part 25B is pressed downward and pushes the developer cartridge 7 upward.

The length L1 from the shaft 25D to the operating part 25B is greater than the length L2 from the shaft 25D to the actuating part 25C. Consequently, the user can move the developer cartridge 7 upward with a relatively small amount of force.

Figure 5A:
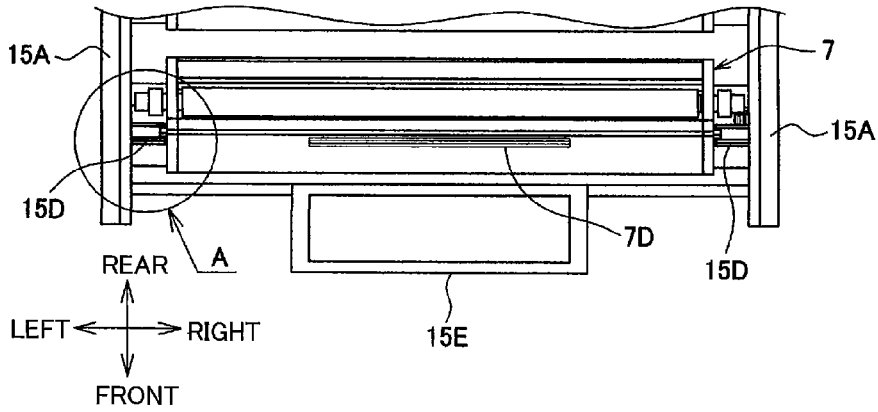
FIG. 5A is a top view of the drawer unit.

Since the actuating part 25C rotates about the corresponding pivoting shaft 25D, the actuating part 25C applies a force in a direction that is not parallel to the moving direction in which the developer cartridge 7 moves (i.e., the vertical direction). Therefore, the second guide parts 15D are provided on the side walls 15A for contacting and guiding movement of the corresponding developer cartridges 7, as shown in FIG. 5A.

Figure 5B:
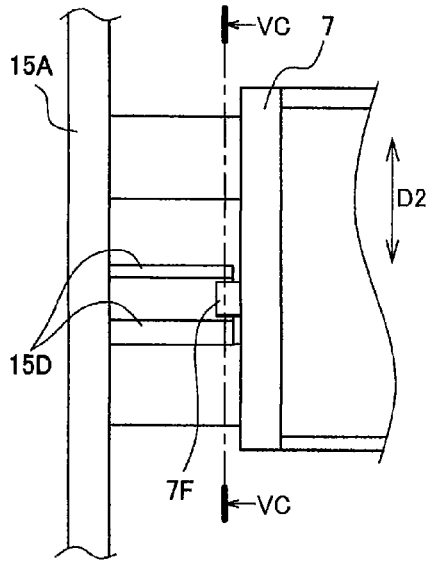
FIG. 5B is an enlarged view of a portion within a circle A shown in FIG. 5A.
Figure 5C:
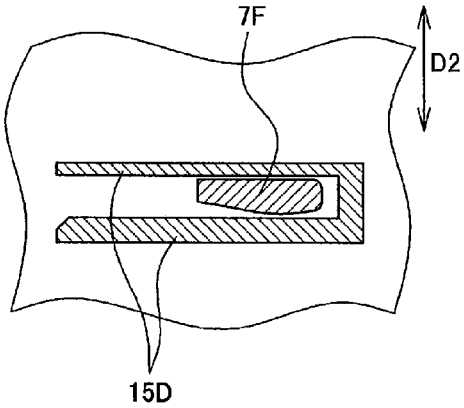
FIG. 5C is a cross-sectional view of the drawer unit taken along a line VC-VC shown in FIG. 5B.

As shown in FIGS. 5B and 5C, each developer cartridge 7 has a protrusion 7F provided on each longitudinal end thereof. The second guide parts 15D are each configured of a pair of parallel walls positioned on both sides of the corresponding protrusion 7F in the juxtaposed direction D2. The protrusions 7F slide in contact with the walls of the corresponding second guide parts 15D in order to guide movement of the corresponding developer cartridge 7 when the developer cartridge 7 is ejected. In the embodiment, the second guide parts 15D are integrally molded with the corresponding side walls 15A. The protrusions 7F are integrally formed on the casings of the developer cartridges 7.

As shown in FIG. 3, each of the developer cartridges 7 has a grip part 7D by which the user can grip the developer cartridge 7. Each grip part 7D is provided on the upper portion of the corresponding developer cartridge 7, i.e., the downstream side of the developer cartridge 7 with respect to the ejecting direction. Anti-slip ridges are provided on each grip part 7D and extend in the longitudinal direction of the same. The grip parts 7D are provided on the same vertical side of the developer cartridge 7 as the developing rollers 7A.

Figure 6A:
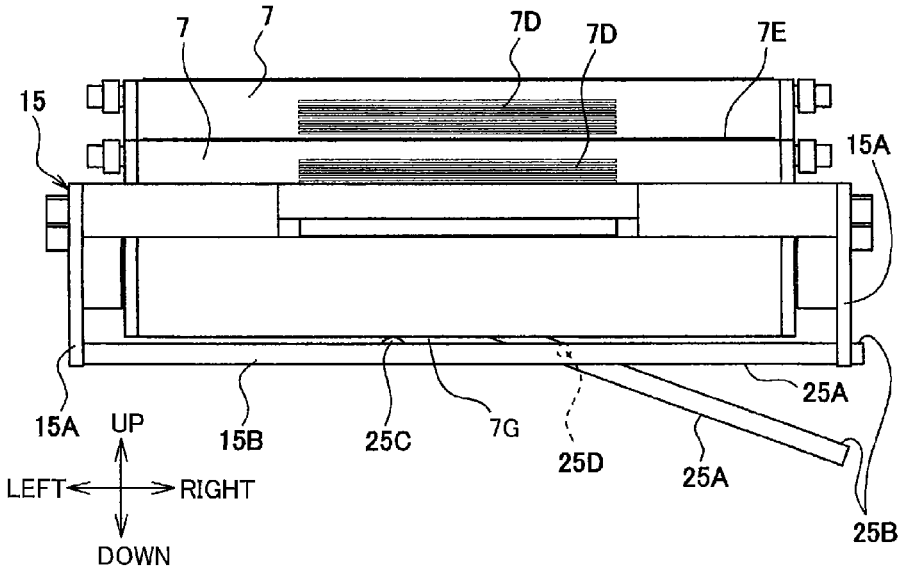
FIG. 6A is an explanatory diagram showing a front view of the drawer unit when the developer cartridge is moved.
Figure 6B:
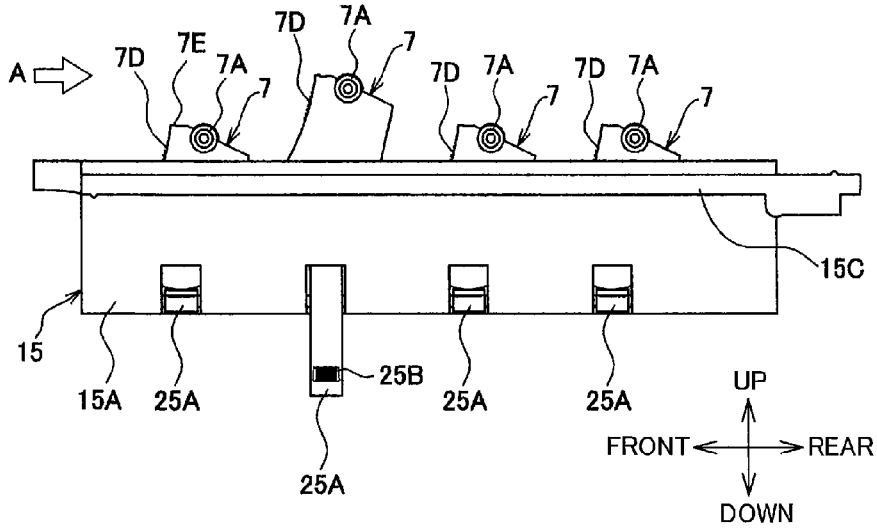
FIG. 6B is an explanatory diagram showing a side view of the drawer unit when the developer cartridge is moved.

As shown in FIGS. 6A and 6B, the grip part 7D of a developer cartridge 7 moved by the corresponding actuating part 25C advances to a position downstream in the ejecting direction from the downstream end of the developer cartridge 7 that has not been moved by the corresponding actuating part 25C. In other words, the grip part 7D of a developer cartridge 7 moved upward by the actuating part 25C is positioned higher than an upper edge 7E of a developer cartridge 7 that has not been moved.

One feature of the embodiment is the ejecting mechanism 25 that has been provided in the drawer 15 for moving the developer cartridges 7 in the ejecting direction intersecting the juxtaposed direction D2 of the developer cartridges 7 and orthogonal to the rotational axes of the developing rollers 7A. Thus, the user can move developer cartridges 7 in the ejecting direction by operating the corresponding operating part 25B of the ejecting mechanism 25. Therefore, the developer cartridges 7 in the embodiment need not be provided with the moving mechanism described above in the prior art. Accordingly, the embodiment provides an image-forming device that is conducive to a compact drawer.

Another feature of the embodiment is that the drawer 15 is configured to move in the juxtaposed direction while being guided by the first guide parts 3A. Thus, the image-forming device 1 according to the embodiment is user-friendly since the drawer 15 moves in the same direction that sheets are conveyed, for example.

Another feature of the embodiment is that the drawer 15 includes the plurality of second guide parts 15D for contacting and guiding movement of respective developer cartridges 7. Hence, the second guide parts 15D ensure that the developer cartridges 7 move properly when ejected by the ejecting mechanism 25 and that the developer cartridges 7 can be reliably remounted in the drawer 15.

In the embodiment, the ejecting mechanism 25 has an ejecting lever 25A corresponding to each of the developer cartridges 7. Each ejecting lever 25A is pivotable about the pivoting shafts 25D, which extends parallel to the juxtaposed direction. Further, an operating part 25B is provided on one end of each ejecting lever 25A while an actuating part 25C is provided on the other end. Accordingly, the ejecting mechanism 25 according to the embodiment can be achieved through a simple structure.

Another feature of the embodiment is that the operating parts 25B are positioned on the opposite side of the longitudinal end of the developer cartridge 7 from the longitudinal center of the same. This construction facilitates the user in operating the operating parts 25B.

Another feature of the embodiment is that the grip part 7D provided on a developer cartridge 7 that has been moved in the ejecting direction is positioned further downstream in the ejecting direction than the upper edge 7E (downstream end) of the developer cartridge 7 that has not been moved. This configuration allows the user to easily grip the grip part 7D of the developer cartridge 7 that has moved in the ejecting direction after operating the corresponding operating part 25B.

If the grip part 7D of a developer cartridge 7 that had been moved were not positioned far enough downstream in the ejecting direction from the position of the grip part 7D prior to movement, the neighboring developer cartridges 7 would like interfere when the user attempts to grip the grip part 7D of the developer cartridge 7 that had been moved. Consequently, the user could have difficulty gripping the grip part 7D of a developer cartridge 7 that had been moved in the ejecting direction.

While this problem could be resolved by providing sufficient space between neighboring developer cartridges 7, such a resolution would lead to a larger drawer 15.

The embodiment described above resolves this problem without increasing the distance between neighboring developer cartridges 7. As described above, the embodiment facilitates the user in gripping the grip part 7D of a developer cartridge 7 by operating the operating part 25B to move the developer cartridge 7.

While the invention has been described in detail with reference to the embodiment thereof, it would be apparent to those skilled in the art that various changes and modifications may be made therein without departing from the spirit of the invention.

The operating part 25B according to the embodiment described above is the portion of the ejecting lever 25A directly operated by the user, but the present invention is not limited to this configuration. For example, a structure may be provided for transmitting the user's operating force to the operating part 25B indirectly. Alternatively, a solenoid or other actuator may be provided to produce an operating force that is applied to the operating part 25B.

The ejecting mechanism 25 according to the embodiment described above employs the ejecting levers 25A, but a mechanism employing a cam or the like may also be used.

The drawer 15 in the embodiment described above can move in a horizontal direction, and specifically the front-rear direction (i.e., the juxtaposed direction). However, the present invention may be applied to a drawer that can move in a horizontal direction orthogonal to the juxtaposed direction.

While the ejecting mechanism 25 according to the embodiment described above has an ejecting lever 25A for each developer cartridge 7, a single ejecting lever 25A may be provided for moving all developer cartridges 7 at once.

In the embodiment described above, the operating part 25B is provided on the opposite side of the longitudinal end 7C from the longitudinal center region of the developer cartridge 7. However, the ejecting mechanism 25 may be configured such that the operating part 25B is positioned on the longitudinal center side of the side wall 15A or on the outside of the side wall 15A, for example.

In the embodiment described above, the ejecting mechanism 25 is positioned on one longitudinal side of the corresponding developer cartridge 7, while the actuating part 25C is positioned in the approximate longitudinal center of the developer cartridge 7. However, the operating part 25B and actuating part 25C may be positioned at both longitudinal ends of the corresponding developer cartridge 7, respectively.

The image-forming device according to the above-described embodiment employs an intermediate transfer system for first transferring developer images onto the transfer belt 13 and subsequently transferring the superimposed images onto a sheet of recording medium. However, the present invention may be applied to an image-forming device employing another type of system, such as a direct transfer system for transferring developer images onto the sheet directly.

What is claimed is:

1. An image forming device comprising:

a main body;

a plurality of developer cartridges juxtaposed in a predetermined direction, each of the plurality of developer cartridges including a corresponding developing roller whose rotational axis extends in an axial direction orthogonal to the predetermined direction;

a drawer configured to move relative to the main body and to which the plurality of developer cartridges are detachably attached, the plurality of developer cartridges being disposed at a first position when the plurality of developer cartridges are attached to the drawer, respectively; and an ejecting mechanism configured to move at least one of the plurality of developer cartridges from the first position in a moving direction relative to the drawer, the moving direction intersecting the predetermined direction and being orthogonal to the axial direction, the ejecting mechanism including:

an operating part configured to receive an operating force; and an actuating part configured to move the at least one of the plurality of developer cartridges from the first position in the moving direction in response to the operating part receiving the operating force, wherein each of the plurality of the developer cartridges has a bottom surface opposite from the corresponding developing roller; and wherein the actuating part is configured to contact the bottom surface of the at least one of the plurality of developer cartridges in response to the operating part receiving the operating force, thereby moving the at least one of the plurality of developer cartridges from the first position in the moving direction.

2. The image forming device according to claim 1, wherein the main body includes a guide portion extending in the predetermined direction; and wherein the drawer is configured to move along the guide portion.

3. The image forming device according to claim 1, wherein the drawer includes a plurality of guide portions corresponding to the plurality of developer cartridges, respectively, each of the plurality of guide portions being configured to guide a corresponding one of the developer cartridges in the moving direction.

4. The image forming device according to claim 1, wherein the drawer is configured to move in a horizontal direction relative to the main body, and wherein the moving direction is defined as an upward direction.

5. The image forming device according to claim 1, wherein the ejecting mechanism includes a plurality of levers, each of the plurality of levers corresponding to each of the plurality of developer cartridges, each of the plurality of levers extending in a direction parallel to the axial direction and being configured to pivot about a rotation axis, each of the plurality of levers having one side portion and another side portion that are defined with reference to the rotation axis, the operating part and the actuating part being provided on the one side portion and the other side portion, respectively.

6. The image forming device according to claim 1, wherein each of the plurality of developer cartridges has a side wall extending in the predetermined direction; and wherein the operating part is positioned outside the side wall of the at least one of the plurality of developer cartridges in the axial direction.

7. The image forming device according to claim 1, wherein each of the plurality of developer cartridges extends in the axial direction and has one end portion, another end portion, and a central portion;

wherein the operating part is positioned at a position closer to the one end portion of the at least one of the plurality of developer cartridges than to the other end portion of the at least one of the plurality of developer cartridges; and wherein the actuating part is positioned so as to confront the central portion of the at least one of the plurality of developer cartridges.

8. The image forming device according to claim 1, wherein the ejecting mechanism is configured to move the at least one of the plurality of developer cartridge from the first position to a second position downstream of the first position in the moving direction, in response to the operating part receiving the operating force.

9. The image forming device according to claim 8, wherein each of the plurality of developer cartridges includes a downstream end in the moving direction and a grip part configured to be gripped by a user, and wherein the grip part of the at least one of the plurality of developer cartridges disposed at the second position is positioned downstream of the downstream end of the at least one of the plurality of developer cartridges disposed at the first position in the moving direction.

10. An image forming device comprising:

a main body;

a plurality of developer cartridges juxtaposed in a predetermined direction, each of the plurality of developer cartridges including a developing roller whose rotational axis extends in an axial direction orthogonal to the predetermined direction;

a drawer configured to move relative to the main body and to which the plurality of developer cartridges are detachably attached, the plurality of developer cartridges being disposed at a first position when the plurality of developer cartridges are attached to the drawer, respectively; and an ejecting mechanism configured to move at least one of the plurality of developer cartridges from the first position in a moving direction relative to the drawer, the moving direction intersecting the predetermined direction and being orthogonal to the axial direction, the ejecting mechanism including:

an operating part configured to receive an operating force; and an actuating part configured to move the at least one of the plurality of developer cartridges from the first position in the moving direction in response to the operating part receiving the operating force, wherein the ejecting mechanism includes a plurality of levers, each of the plurality of levers corresponding to each of the plurality of developer cartridges, each of the plurality of levers extending in a direction parallel to the axial direction and being configured to pivot about a rotation axis, each of the plurality of levers having one side portion and another side portion that are defined with reference to the rotation axis, the operating part and the actuating part being provided on the one side portion and the other side portion, respectively.

11. The image forming device according to claim 10,
wherein the drawer is configured to move in a horizontal direction relative to the main body, and
wherein the moving direction is defined as an upward direction.

12. The image forming device according to claim 10,
wherein each of the plurality of developer cartridges has a side wall extending in the predetermined direction; and
wherein the operating part is positioned outside the side wall of the at least one of the plurality of developer cartridges in the axial direction.

13. The image forming device according to claim 10,
wherein each of the plurality of developer cartridges extends in the axial direction and has one end portion, another end portion, and a central portion;
wherein the operating part is positioned at a position closer to the one end portion of the at least one of the plurality of developer cartridges than to the other end portion of the at least one of the plurality of developer cartridges; and
wherein the actuating part is positioned so as to confront the central portion of the at least one of the plurality of developer cartridges.

14. The image forming device according to claim 10, wherein the ejecting mechanism is configured to move the at least one of the plurality of developer cartridge from the first position to a second position downstream of the first position in the moving direction, in response to the operating part receiving the operating force.

15. The image forming device according to claim 14,
wherein each of the plurality of developer cartridges includes a downstream end in the moving direction and a grip part configured to be gripped by a user, and
wherein the grip part of the at least one of the plurality of developer cartridges disposed at the second position is positioned downstream of the downstream end of the at least one of the plurality of developer cartridges disposed at the first position in the moving direction.

16. An image forming device comprising:
a main body;
a plurality of developer cartridges juxtaposed in a predetermined direction, each of the plurality of developer cartridges including a developing roller whose rotational axis extends in an axial direction orthogonal to the predetermined direction;
a drawer configured to move relative to the main body and to which the plurality of developer cartridges are detachably attached, the plurality of developer cartridges being disposed at a first position when the plurality of developer cartridges are attached to the drawer, respectively; and
an ejecting mechanism configured to move at least one of the plurality of developer cartridges from the first position in a moving direction relative to the drawer, the moving direction intersecting the predetermined direction and being orthogonal to the axial direction, the ejecting mechanism including:
an operating part configured to receive an operating force; and
an actuating part configured to move the at least one of the plurality of developer cartridges from the first position in the moving direction in response to the operating part receiving the operating force,
wherein each of the plurality of developer cartridges extends in the axial direction and has one end portion, another end portion, and a central portion;
wherein the operating part is positioned at a position closer to the one end portion of the at least one of the plurality of developer cartridges than to the other end portion of the at least one of the plurality of developer cartridges; and
wherein the actuating part is positioned so as to confront the central portion of the at least one of the plurality of developer cartridges.

17. The image forming device according to claim 16,
wherein the drawer is configured to move in a horizontal direction relative to the main body, and
wherein the moving direction is defined as an upward direction.

18. The image forming device according to claim 16,
wherein each of the plurality of developer cartridges has a side wall extending in the predetermined direction; and
wherein the operating part is positioned outside the side wall of the at least one of the plurality of developer cartridges in the axial direction.

19. The image forming device according to claim 16, wherein the ejecting mechanism is configured to move the at least one of the plurality of developer cartridge from the first position to a second position downstream of the first position in the moving direction, in response to the operating part receiving the operating force.

20. The image forming device according to claim 19,
wherein each of the plurality of developer cartridges includes a downstream end in the moving direction and a grip part configured to be gripped by a user, and
wherein the grip part of the at least one of the plurality of developer cartridges disposed at the second position is positioned downstream of the downstream end of the at least one of the plurality of developer cartridges disposed at the first position in the moving direction.

* * * * *